United States Patent [19]

Slathar et al.

[11] 3,961,462

[45] June 8, 1976

[54] APPARATUS FOR WRAPPING CONFECTIONERY PRODUCTS AND THE LIKE

[75] Inventors: Donald A. Slathar, Chanhassen; Christiaan H. Neutkens, Cottage Grove, both of Minn.

[73] Assignee: International Telephone and Telegraph Corporation, Nutley, N.J.

[22] Filed: Feb. 4, 1975

[21] Appl. No.: 547,071

[52] U.S. Cl. ..... 53/221

[51] Int. Cl.[2] ..... B65B 11/54

[58] Field of Search..... 53/59 R, 220, 221, 222, 53/223, 226; 198/34, 220 BA

[56] References Cited

UNITED STATES PATENTS

| | | | |
|---|---|---|---|
| 1,392,683 | 10/1921 | Hackett | 53/221 |
| 1,424,363 | 8/1922 | Leuman | 53/226 X |
| 2,739,695 | 3/1956 | Haycock | 198/34 |
| 2,757,499 | 8/1956 | Albrecht | 53/226 |
| 3,207,909 | 9/1965 | Lakso | 53/59 R |
| 3,248,844 | 5/1966 | Cross | 53/59 R X |
| 3,286,814 | 11/1966 | Atkinson | 198/34 |
| 3,391,520 | 7/1968 | Albrecht | 53/226 X |
| 3,730,386 | 5/1973 | Monsees | 53/59 R X |

*Primary Examiner*—Travis S. McGehee
*Assistant Examiner*—John Sipos
*Attorney, Agent, or Firm*—John T. O'Halloran; Menotti J. Lombardi

[57] ABSTRACT

The products to be wrapped are moved from an input conveyor belt onto a vibrating infeed and proceed through a timing wheel which predeterminedly spaces the products. The products are dropped into a receiving yoke, and a sheet of wrapping paper is positioned such that a reciprocating plunger moves the paper and product through a forming cone and into a wrapping head which folds and closes the paper on the product.

22 Claims, 2 Drawing Figures

APPARATUS FOR WRAPPING CONFECTIONERY PRODUCTS AND THE LIKE

BACKGROUND OF THE INVENTION

This invention relates to a new and improved apparatus for wrapping individual and similarly shaped confectionery and non-confectionery items, and more particularly, to wrapping mints and the like.

The prior art apparatus is known from the present assignee's previously assigned U.S. Pat. Nos. 2,757,499 and 3,391,520; and this invention provides an improved and simplified arrangement for accomplishing the automatic and continuous individual wrapping of each item.

The referenced U.S. Pat. No. 2,757,499 is directed in general to a machine wherein the individual articles are pushed through a stuffing tunnel to shape a planar sheet fragment into the form of a bag surrounding the entering end and peripheral portion of the article leaving a skirt. Thereafter, the skirt is twisted and crimped in order to form about the opposite end of the article a complete wrap to substantially seal each article or unit in a tightly wrapped manner. Specifically, the machine of this patent is associated with a conventional article conveyor line and includes a receiving chamber for delivering the articles in a predetermined position. A machine mechanism intermittently projects the free end of a strip of flexible wrapping material into a planar position above or in front of the article. The machine thereafter severs the outer portion of the strip into a wrapping fragment and brings the article with the severed fragment into a stuffer tunnel to cover the forward end and periphery of the article in a bag formation within the wrapper. Thereafter, the twist and skirt portion is formed tightly about the article completing the wrapping operation, all of which is operatively synchronized in the successive operations for wrapping the individual articles.

An improved appparatus for wrapping the individual confectionery products was disclosed in U.S. Pat. No. 3,391,520 in which the machine retained a piece of confectionery product adjacent a continuous web of wrapping material. While the piece was retained by the conveyor mechanism, the web was severed and pushed with the piece to fold the wrapper about the piece to complete the fold. This apparatus included a drum mechanism for individually indexing each head with a mint through a number of angular locations while the material was retained adjacent one surface of the pieces for each head severing the web to form a wrapper. A plunger mechanism forwarded the confectionery piece out of the drum assembly and moved the stationary piece to partially fold the wrapper about said piece, and the folding was completed at the wrapping station. A severing mechanism was included for feeding a sheet of wrapping material from the web to form individual wrappers for movement into the wrapping station. In the wrapping station, the mint is pushed out of the drum assembly aperture and against the severed wrapper to build the outer parametric portions of the wrapper and to fold the outer parametric portions of the wrapper to complete the wrapping of the confectionery piece which was accomplished in the wrapping head. The wrapping head included a series of folders for each drum assembly to complete the wrapping operation, each series of elements being synchronized to complete the folding of the paper to completely wrap the confectionery piece.

Insofar as the referenced patents are necessary for an understanding and to enable practicing the instant invention, the patents are hereby incorporated by reference. The improved apparatus according to the present invention provides a simplified arrangement for feeding and conveying the individual items to be wrapped into the wrapping head. The improvements include a simplified plunger and infeed drive so that the overall operation is simpler. A number of features are incorporated to provide a mint wrapper having simple construction and operation; this results in a lower cost and easier to maintain machine as will become evident by reference to the following specification.

SUMMARY OF THE INVENTION

It is therefore an object of the present invention to provide an improved article wrapping machine which is comparatively simple, compact and efficient.

Another object of the invention is to provide an improved wrapping machine for wrapping mints and similarly shaped products in a continuous manner and without all the complexity required by the previous automatic equipment.

According to the broader aspects of the invention, there is provided a means to accomplish wrapping of a mint confectionery product by properly displacing a product into a receiving yoke, and means for pushing the product with a sheet of wrapping material into a wrapping head.

A feature of the invention is an improved plunger and infeed drive mechanism wherein an indexing means is timed with a plunger so that the displaced mint product is synchronously pushed with the sheet of wrapping material into the wrapping head in a continuous manner.

BRIEF DESCRIPTION OF THE DRAWINGS

The foregoing objects and features and advantages of the present invention will be more easily understood with reference to the following description made in connection with the accompanying drawings, in which.

DESCRIPTION OF THE PREFERRED EMBODIMENT

Figure 1:
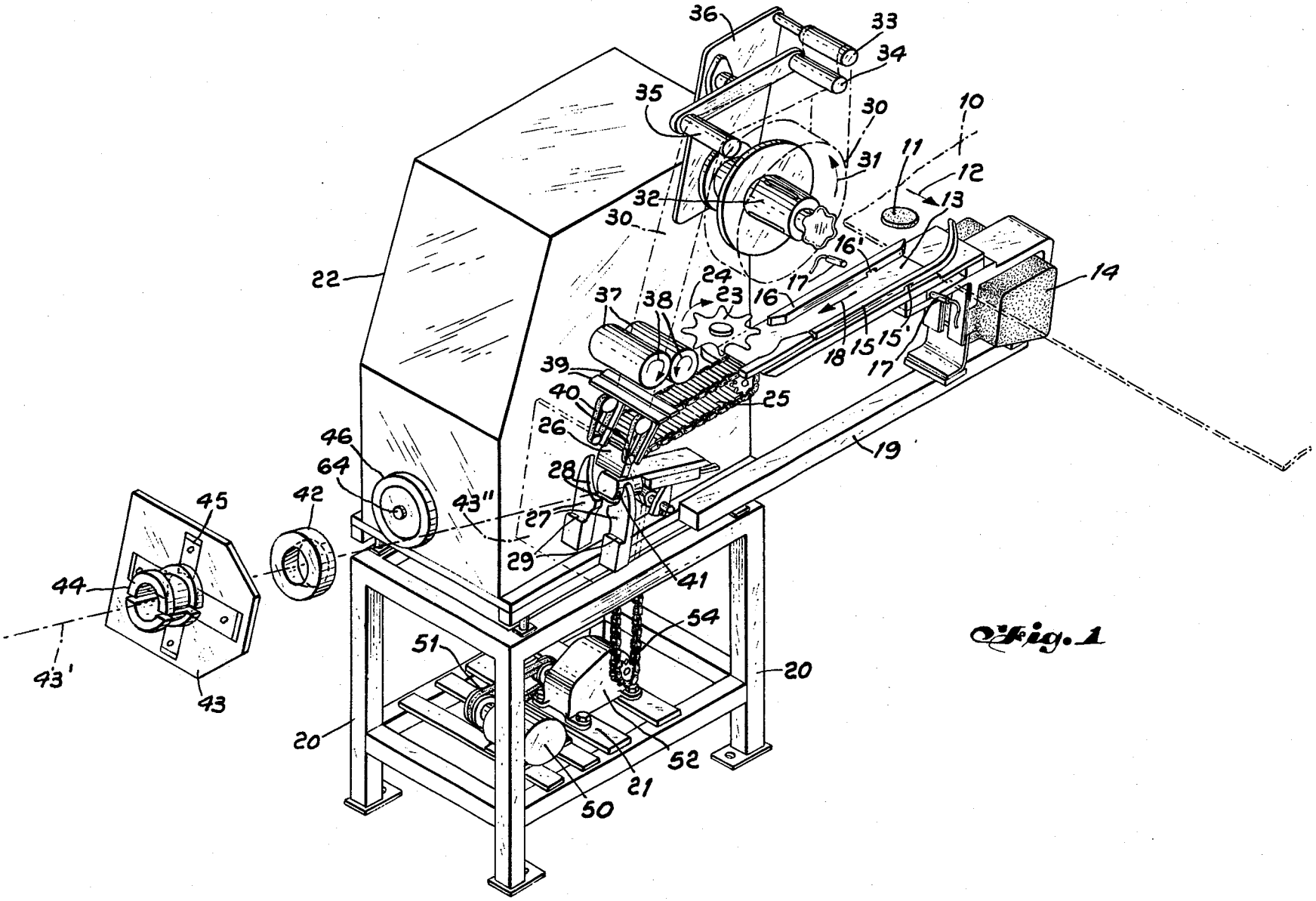
FIG. 1 is an illustrative perspective view showing the essential elements of the invention.

Referring now to the drawings, the apparatus of the invention will be disclosed with reference to wrapping mints and it being understood that it can be utilized to wrap other similarly shaped confectionery and non-confectionery products. In FIG. 1, an infeed belt 10 carries the mint 11 in the direction of arrow 12 and into the product entry point of vibrator infeed 13 of vibrator drive 14. The vibrator drive may be of the type as supplied by Syntron, type BF-01-C Feeder, Homer City, Pa. The vibrator infeed 13 has mounted thereon channeling guides 15, 16 into which are cut slots 15′, 16′ to enable operation of an electric eye means 17. This permits counting of the mints as they are carried forward by the vibrating infeed in the direction of arrow 18, or shutting down the machine when no mints are present. The vibrator 14 is mounted by support extension 19 on machine frame 20. Also mounted on the machine frame 20 is a drive unit 21 and a drive mechanism within housing 22 as more particularly described in connection with FIG. 2.

Figure 2:
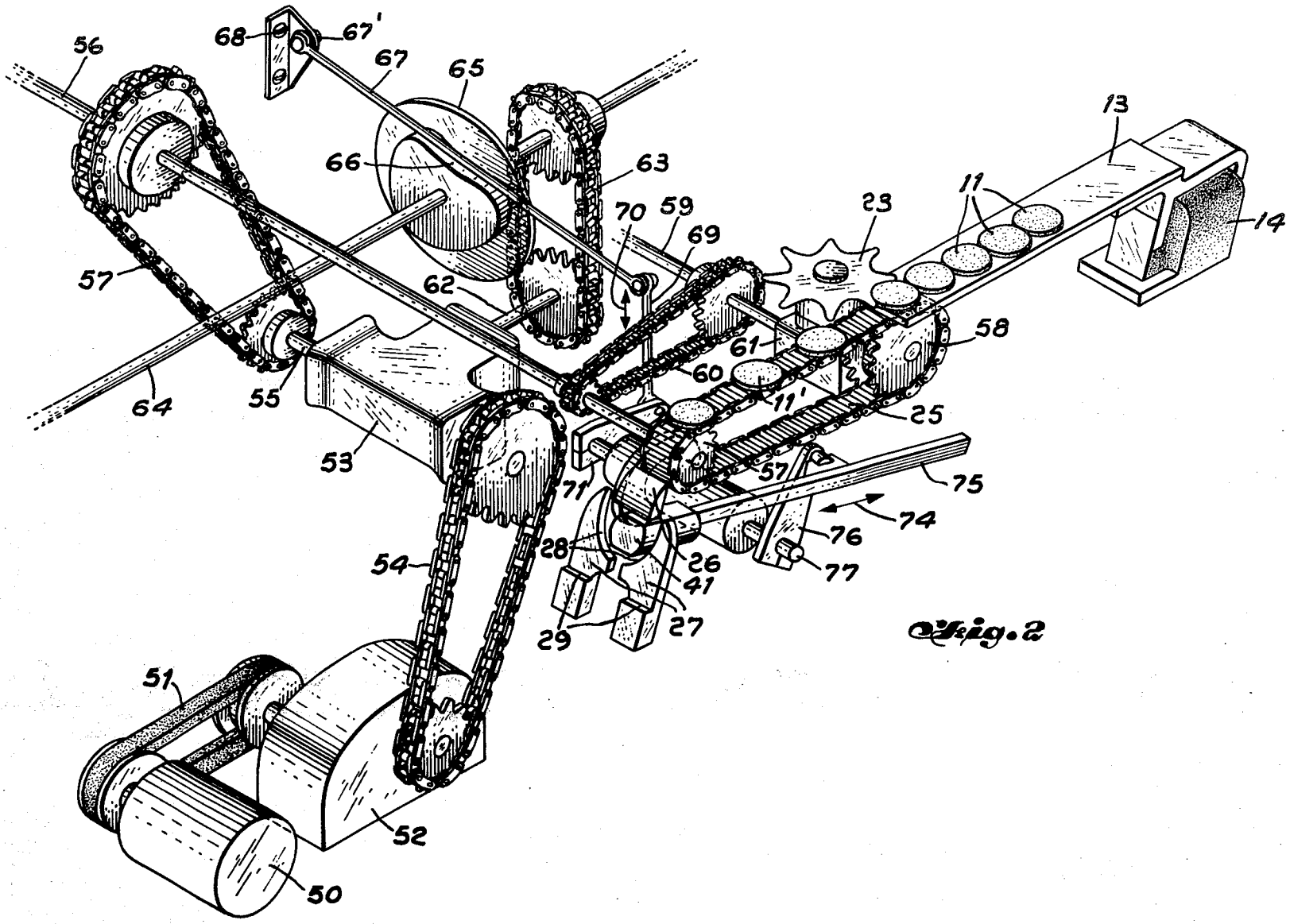
FIG. 2 is an illustrative perspective view showing the essential mechanisms for providing the plunger and infeed drive for the novel elements of the invention.

A timing and indexing wheel 23 moving in the direction of arrow 24 engages individual ones of the mints 11 and carries the mints forward, one at a time, as shown in FIG. 2, and in a timed relationship onto dual chain conveyor 25. The mints are carried forward in a continuous manner by the chain conveyor and displaced onto drop guide 26 to be caught by receiving yokes 27 in its U-shaped portion 28.

In the meantime, a web of paper wrap 30 shown in dashed lines is fed from a roll moving in the direction of arrow 31. The paper wrap is comprised of aluminum foil and wax paper, and is cut and fed into the paper stop portion 29 of yoke members 27. The paper roll is rotatably mounted and held by hub means 32, and the paper web passes over paper guides 33, 34, 35 mounted on support 36. The paper web 30 is fed between paper infeed rollers 37 driven in the direction of arrows 38 and between cutting knives 39. The cut sheet of paper is fed between feed belts 40 and stationary guides behind belts and yoke members 27 to stop 29. The paper is cut by repeated closing of the cutters in time sequence with the timing wheel 23 or the plunger 41 in a standard manner as known by the prior referenced patents.

In time relationship with indexing of timing wheel 23, a plunger 41 pushes the mint held within U-shaped portion 28 of yoke members 27 and forces the paper sheet and the mint through forming cone 42 into the wrapping head 43. The cone 42 and wrapping head 43 are shown centered on dashed lines 43' in an isometric displaced projection for clarity, whereas in reality they are positioned as indicated by dotted lines 43'. The wrapping head includes a wrapped product outlet 44 and four wrapping tuckers 45 which are operated to individually wrap the mints with the paper as known from the cross-referenced prior art applications. The operation of the wrapping tuckers, paper feed and cutters is not shown in further detail since they are well known and adequately demonstrated in the prior art patents and do not require further disclosure to enable understanding of the inventive features for this new wrapping machine. The handwheel 46 is positioned outside housing 22 to enable hand operation of the plunger mechanism for adjustment and clearance of an item when desired.

Referring now to FIG. 2, the novel feature of the plunger and infeed drive mechanism for this improved wrapping machine is illustrated in greater detail. A motor 50 is coupled by drive belt 51 to gear box 52 which is coupled to drive main angle gear 53 via drive sprockets and chain 54. One output shaft 55 from main angle gear 53 is coupled to the product infeed shaft 56 by a 2:1 ratio sprockets and chain 57. Shaft 56 drives the drive sprocket wheels 57 of dual chain conveyor 25 also rotatably mounted about sprocket wheels 58. Coupled to product infeed shaft 56 is an angle gear drive shaft 59 by means of a 2:1 ratio drive sprockets and chain 60. The angle gear drive shaft 59 drives a 2:1 ratio angle gear 61 to rotate timing wheel 23 shaped to engage the mints 11.

The vibrator 14 is infeeding the mints 11 to timing wheel 23 by means of the vibrating infeed 13. The mints 11 are received in a spaced relationship 11' on dual chain conveyor 25 which displaces the mints on drop guide 26 and into the U-shaped portion of the yoke. Plunger 41 then pushes the mint into the forming cone for wrapping as described in connection with FIG. 1. The synchronized operation is accomplished in the following manner. Another output shaft 62 from main angle gear 53 is coupled by drive sprockets and chain 63 to drive main cam shaft 64. The main cam shaft 64 is also coupled to handwheel 46 of FIG. 1. Mounted on the main cam shaft 64 is a plunger cam 65 having a camming surface 66 to effect movement of cam plunger follower 67 which is mounted at one end by bracket 68 and at the other end to linkage member 69. This enables movement of the follower 67 in the direction of arrow 70 in accordance with the movement of camming surface 66. Linkage 69 is coupled by pivot and linkage element 71 to translate the up and down motion represented by arrow 70 to the plunger in and out motion represented by arrows 74. The timing wheel 23 can be rotated 360° and locked in any position. The mint patties are timed out by the timing wheel 23 onto dual chain conveyor 25, such that when the foremost mint patty 11 drops into receiving yoke 27 in its U-shaped portion 28, the plunger 41 at that time has just reached the fully backward stroke.

In summary, the improved wrapping machine enables confectionery mints moving on a conveyor feed belt to be captured and fed by a vibrating infeed into a timing wheel. The timing wheel then engages the mint patties to feed them in a spaced manner onto a dual chain conveyor which displaces and drops them into a receiving yoke. Wrapping paper is fed from a roll through infeed rollers and cut into equal lengths with reciprocating knives in a standard manner. The cut paper sheet is then fed down by two paper feed belts onto paper stops of the receiving yoke. A plunger moves forward in timed and sequenced relationship with the timing wheel and pushes the paper sheet and mint patty through a forming cone into a wrapping head where tuckers move in and out to fold and close the paper on the rear side of the patty to complete the wrap.

Although the apparatus has been disclosed with reference to wrapping mints, it can be used to wrap other similarly shaped confectionery and non-confectionery products. It is further understood that the specific operation of the cam assemblies may be varied relative to specific angular positions of the gearing and drive coupling without changing the basic operating sequence and inventive features of the invention. A number of wrapping materials and different types of cutting edges may be utilized than described in connection with the particular enabling disclosure. This is particularly true since various products require different type wrapping material and cutting edges for cutting the wrapping material at the wrapping point of the apparatus.

While we have described above the principles of our invention in connection with specific apparatus, it is to be clearly understood that this description is made only by way of example and not as a limitation to the scope of our invention as set forth in the objects thereof and in the accompanying claims.

We claim:

1. Apparatus for successively wrapping individual and similarly shaped items, comprising:

vibrating means for receiving said items and feeding said items into the apparatus;

indexing means coupled to receive said fed items and to move said items along in a spaced sequence in the apparatus;

a stationary receiving yoke;

conveying means for feeding and displacing the items into said receiving yoke, said yoke located below said conveying means; and means operable to push said items in said yoke into a wrapping means.

2. The apparatus of claim 1 wherein said wrapping means includes a source of wrapping material;

a forming cone; and a wrapping head, whereby said pushing means moves an item and a sheet of said material through the forming cone and into the wrapping head for wrapping.

3. The apparatus of claim 1 wherein said receiving yoke is a U-shaped receiving yoke formed by a pair of spaced apart complementary members, said member having wrapping material stop portions.

4. The apparatus of claim 1 wherein push means includes a reciprocating plunger operated in timed sequence with said indexing means.

5. The apparatus of claim 1 wherein said conveying means includes a stationary drop guide for guiding the drop of said items into the receiving yoke.

6. The apparatus of claim 1 wherein said indexing means includes a timing wheel for engaging individual ones of said fed items and feeding the engaged items in a continuous spaced sequence onto the conveying means.

7. The apparatus of claim 1 wherein said feeding and receiving means includes a vibrator drive and vibrating infeed, said vibrating infeed having channeling members to direct the items from an item entry source into the indexing means in a channeled manner.

8. Apparatus for moving uniformly shaped pieces from an infeed position to a wrapping position where each piece is individually wrapped in a flexible wrapping sheet, the apparatus including a vibrating infeed for the pieces;

a timing means for receiving said fed pieces and moving said pieces in an indexed sequence along the feeding path;

a conveyor for moving said pieces to a displacing position below the feeding path;

a stationary receiving yoke located below said conveyor and stationary guide means, said guide means to direct the displacement of said pieces into a U-shaped portion of the receiving yoke; and a reciprocating plunger, said plunger in its forward stroke moves each piece and its associated wrapping sheet into a forming cone and wrapping head wherein the piece is enclosed within the sheet.

9. Apparatus according to claim 8, comprising:

a drive means; and a drive mechanism coupled between said drive and timing means and said reciprocating plunger, whereby said mechanism synchronizes the movement of the plunger in relation to said timing means.

10. Apparatus according to claim 9 wherein said timing means is a timing wheel; and said mechanism includes a plunger cam to effect the reciprocating motion of said plunger relative to the rotational movement of said timing wheel.

11. In apparatus for successively wrapping individual and similarly shaped confectionery items, having a frame, means on said frame for sequentially feeding sheets of wrapping material, and a wrapping head adjacent one side of the material, the improvement comprising:

vibrating means for feeding said items into the apparatus along a vibrating path;

timing means positioned in said path to engage said fed items and to move them along in a timed sequence in the apparatus;

a stationary drop guide and stationary receiving yoke;

conveying means adjacent the timing means for coupling and displacing the items onto said guide and yoke, said yoke located below said conveying means; and means reciprocally operable to push said item in said yoke and one of said sheets into a wrapping means.

12. The apparatus of claim 11 wherein said receiving yoke has a U-shaped receiving portion formed by a pair of complementary members, said member having wrapping material stop portions.

13. The apparatus of claim 12 wherein push means includes a reciprocating plunger operated in timed sequence with said timing means to push the item held in said U-shaped portion into the wrapping head.

14. The apparatus of claim 13 wherein said timing means includes a timing wheel for engaging each of said fed items and sequentially feeding the engaged items in a spaced manner onto the conveying means.

15. The apparatus of claim 14 wherein said vibrating means includes a vibrator drive and vibrating infeed, said vibrating infeed receiving said items from a feed conveyor and having channeling members to direct the items from the feed conveyor into the timing means in a channeled manner.

16. In apparatus for moving uniformly shaped circular confectionery pieces from an infeed position to a wrapping position where each piece is individually wrapped in a flexible wrapping sheet, the apparatus comprising in combination:

a vibrating infeed for the pieces;

a timing means for receiving said fed pieces and moving said pieces in a spaced sequence along the feeding path;

a conveyor for moving said pieces to a dropping position;

a stationary receiving yoke located below said conveyor and stationary guide means, said guide means to direct the dropping of said pieces into the receiving yoke;

a reciprocating plunger, said plunger in its forward stroke moves each piece and its associated wrapping sheet into a forming cone and wrapping head wherein the piece is enclosed within the sheet; and a drive means and drive mechanism coupled between said drive and timing means and said reciprocating plunger, whereby said mechanism synchronizes the movement of the plunger in relation to said timing means.

17. The combination of claim 16 wherein said timing means is a timing wheel; and said mechanism includes a plunger camming surface which controls the reciprocating motion of said plunger relative to the rotational movement of said timing wheel.

18. A machine for individually wrapping pieces of confectionery items in a flexible wrapping material, comprising:

a frame;

a drive unit and drive mechanism mounted on said frame;

an infeed belt for feeding the confectionery items into the machine;

a vibrator drive and a vibrating infeed having channeling members to direct the items from the belt into the machine in a channeling manner;

a timing wheel for engaging each of said channeled pieces to move said items along in a timed and spaced sequence;

a conveying means for conveying said timed and spaced items to a discharge position;

a stationary guide and stationary receiving yoke positioned beneath said conveying means in said discharge position, such that the conveyed items are dropped by said conveying means onto said guide means and caught by a U-shaped portion of said receiving yoke;

a source of wrapping paper rotatably mounted and delivered by a wrapping strip mechanism including a rotatably mounted and driven roller, roller guides, a pair of driven infeed rollers, a cutting edge and a wrapping feed belt for positioning a strip of said wrapping paper against paper stops on said receiving yoke forward of said conveyed items; and a reciprocating plunger to push said wrapping sheet and said item positioned in said yoke forward into a forming cone and a wrapping head wherein the item is enclosed within the wrapping sheet.

19. The machine according to claim 18 wherein said drive mechanism includes gear means having a first geared output for driving a plunger cam, the camming surface being coupled to control the reciprocating motion of said plunger; and said gear means having a second output coupled through a predetermined ratio to said timing wheel, whereby said predetermined ratio and said camming surface are operative to predeterminedly synchronize the reciprocal motion of said plunger and said timing wheel.

20. The machine of claim 19 including a main cam shaft having a handwheel adjustment to enable the plunger cam follower arm to be adjustably positioned on said camming surface for setting the predetermined synchronization between said reciprocating plunger and timing wheel.

21. The machine of claim 20 including electric eye means positioned adjacent said vibrating infeed to count the individual pieces being channeled into the machine by said vibrating infeed.

22. A machine for individually wrapping pieces of circular confectionery items in a flexible sheet of wrapping material comprising in combination:

an infeed belt for feeding the confectionery items into the machine;

a vibrator drive and a vibrating infeed having channeling members to direct the items from the belt into the machine in a channeling manner;

a timing wheel for engaging each of said channeled pieces to move said items along in a spaced sequence;

a conveying means for conveying said items to a dropping point;

a stationary guide and stationary receiving yoke positioned beneath said conveying means at said dropping point such that the conveyed items are dropped by said conveying means onto said guide means and received in formed portions of said receiving yoke; and a reciprocating plunger to push said wrapping sheet and said item retained in the formed portion of said yoke through a forming cone and into a wrapping head wherein the item is enclosed within the wrapping sheet.

* * * * *